US009212526B1

(12) United States Patent
Barnes et al.

(10) Patent No.: US 9,212,526 B1
(45) Date of Patent: Dec. 15, 2015

(54) PORTABLE MOVEABLE HORIZONTAL TO VERTICAL PIPE HANDLER

(71) Applicant: LOADMASTER UNIVERSAL RIGS, INC., Houston, TX (US)

(72) Inventors: R. Michael Barnes, Magnolia, TX (US); James A. Zapico, Houston, TX (US)

(73) Assignees: Canyon Oak Energy LLC, Houston, TX (US); Loadmaster Universal Rigs, Inc., Houston, TX (US)

( * ) Notice: Subject to any disclaimer, the term of this patent is extended or adjusted under 35 U.S.C. 154(b) by 446 days.

(21) Appl. No.: 13/679,967

(22) Filed: Nov. 16, 2012

Related U.S. Application Data

(60) Provisional application No. 61/587,499, filed on Jan. 17, 2012.

(51) Int. Cl.
*E21B 19/15* (2006.01)
*E21B 19/14* (2006.01)

(52) U.S. Cl.
CPC ..... *E21B 19/14* (2013.01)

(58) Field of Classification Search
CPC ..... E21B 19/14; E21B 19/146; E21B 19/15; E21B 19/155; E21B 19/20
See application file for complete search history.

(56) References Cited

U.S. PATENT DOCUMENTS

| | | | | |
|---|---|---|---|---|
| 4,403,897 | A * | 9/1983 | Willis | 414/22.55 |
| 4,604,724 | A * | 8/1986 | Shaginian et al. | 700/213 |
| 4,687,401 | A * | 8/1987 | Gilanyi | 414/22.53 |
| 4,759,414 | A * | 7/1988 | Willis | 175/170 |
| 4,899,832 | A * | 2/1990 | Bierscheid, Jr. | 173/187 |
| 6,220,807 | B1 * | 4/2001 | Sorokan | 414/22.62 |
| 6,533,519 | B1 * | 3/2003 | Tolmon et al. | 414/22.54 |
| 7,246,983 | B2 * | 7/2007 | Zahn et al. | 414/22.65 |
| 2004/0007388 | A1 * | 1/2004 | Mills et al. | 175/52 |
| 2005/0194189 | A1 * | 9/2005 | Barnes | 175/122 |
| 2007/0221385 | A1 * | 9/2007 | Braun et al. | 166/379 |
| 2010/0034620 | A1 * | 2/2010 | Orgeron | 414/22.55 |
| 2010/0104401 | A1 * | 4/2010 | Hopkins et al. | 414/22.54 |
| 2010/0329823 | A1 * | 12/2010 | Baumler et al. | 414/22.55 |
| 2011/0226530 | A1 * | 9/2011 | Tarique | 175/27 |
| 2012/0195716 | A1 * | 8/2012 | Nouwens et al. | 414/22.55 |
| 2013/0336748 | A1 * | 12/2013 | Hilton | 414/22.62 |
| 2013/0343838 | A1 * | 12/2013 | Flusche | 414/22.62 |
| 2013/0343858 | A1 * | 12/2013 | Flusche | 414/800 |

FOREIGN PATENT DOCUMENTS

| | | | |
|---|---|---|---|
| CA | 2551884 | A1 * | 1/2007 |

* cited by examiner

*Primary Examiner* — Benjamin Fiorello
(74) *Attorney, Agent, or Firm* — Lowenstein Sandler LLP; Cicero H. Brabham, Jr.

(57) ABSTRACT

A portable moveable horizontal to vertical pipe handler for a drilling rig having a high load non-deforming frame; a plurality of hydraulic lifting cylinders secured between the high load non-deforming frame and a hydraulic power unit; a tapered beam attached to the frame, a plurality of bottom and top securing grippers for grabbing a tubular; a pinion allowing the tapered beam with grippers holding a tubular to pivot from a horizontal position to a vertical position using the hydraulic lifting cylinders; a pair of moveable skates connected to the tapered beam to elevate the tubular and a controller communication with the hydraulic lifting cylinder, the securing grippers and the skates. The controller has a processor with computer instructions for operating the hydraulic cylinders, moveable skates, and securing grippers synchronously or independently.

21 Claims, 7 Drawing Sheets

PORTABLE MOVEABLE HORIZONTAL TO VERTICAL PIPE HANDLER

CROSS REFERENCE TO RELATED APPLICATION

The current application claims the priority of and the benefit of U.S. Provisional Patent Application Ser. No. 61/587,499 filed Jan. 17, 2012, entitled "PORTABLE MOVEABLE HORIZONTAL TO VERTICAL PIPE HANDLER." This reference is hereby incorporated in its entirety.

FIELD

The present embodiments generally relate to portable moveable horizontal to vertical pipe handler.

BACKGROUND

A need exists for a portable moveable horizontal to vertical pipe handler that can accommodate various lengths of tubulars.

A further need exists for portable moveable horizontal to vertical pipe handler that can safely move one or more tubulars from a vertical position to a horizontal position.

The present embodiments meet these needs.

BRIEF DESCRIPTION OF THE DRAWINGS

The detailed description will be better understood in conjunction with the accompanying drawings as follows.

Figure 1:
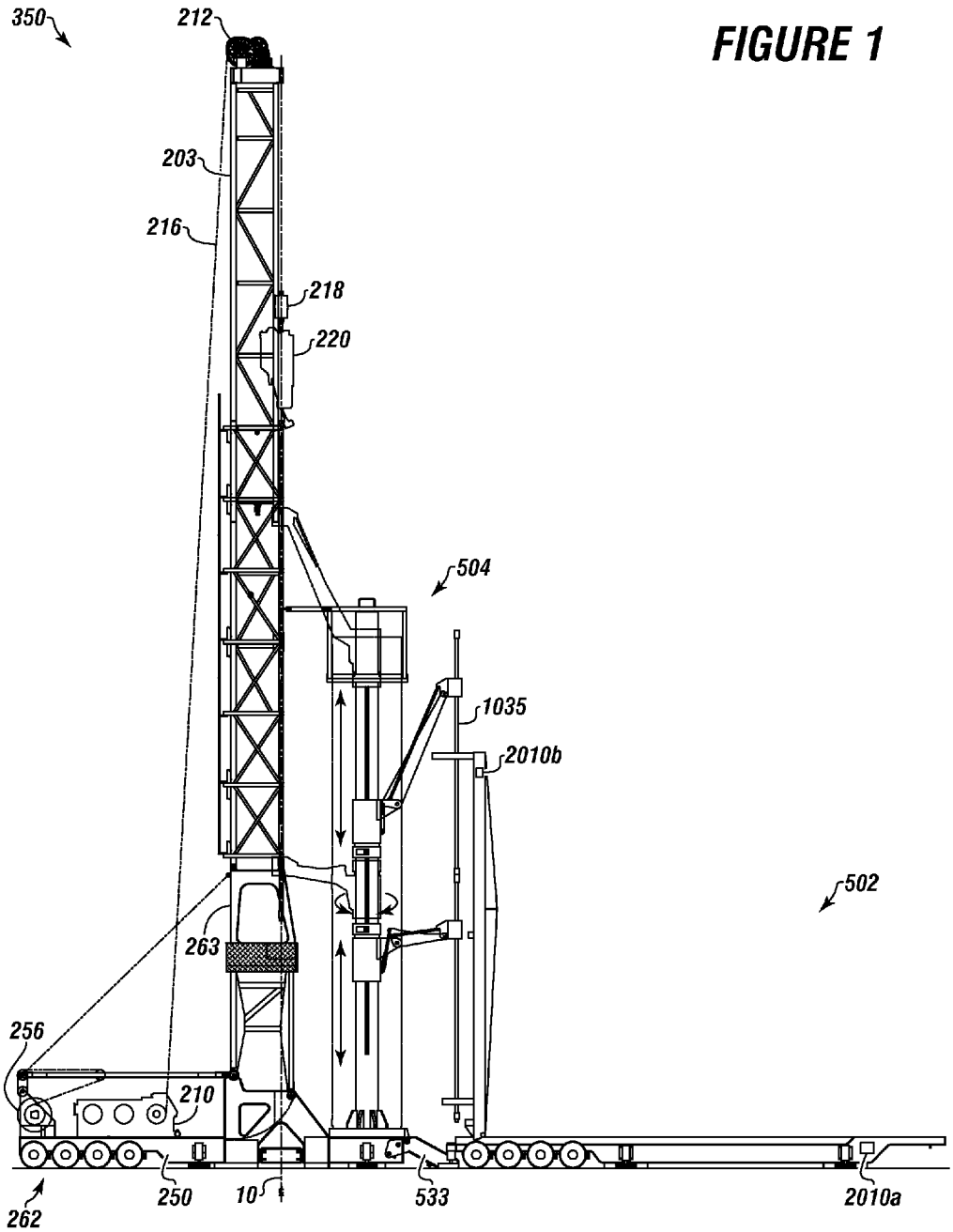
FIG. 1 depicts a rig in a deployed position with a horizontal to vertical pipe handler attached to a vertical pipe handler attached to the drilling rig.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The present embodiments relate to a portable moveable horizontal to vertical pipe handler.

The portable moveable horizontal to vertical pipe handler can be used with a drilling rig.

The portable moveable horizontal to vertical pipe handler can have a high load non-deforming frame; a plurality of hydraulic lifting cylinders secured between the high load non-deforming frame and a hydraulic power unit; a tapered beam attached to the frame, a plurality of bottom and top securing grippers for grabbing a tubular; a pinion allowing the tapered beam with grippers holding a tubular to pivot from a horizontal position to a vertical position using the hydraulic lifting cylinders; a pair of moveable skates connected to the tapered beam to elevate the tubular and a controller communication with the hydraulic lifting cylinder, the grippers, and the skates, wherein the controller comprises a processor with computer instructions for operating the hydraulic cylinders, moveable skates, and grippers synchronously or independently.

The portable moveable horizontal to vertical pipe handler can be used with a drilling rig with a substructure and a mast.

The portable moveable horizontal to vertical pipe hander can include a high load non-deforming frame.

The high load non-deforming frame can have one or more hydraulic lifting cylinders connected therewith. The hydraulic lifting cylinders can be in communication with a hydraulic fluid supply. The hydraulic fluid supply can be supported by the high load non-deforming frame.

The portable moveable horizontal to vertical pipe hander can be secured with the high load non-deforming frame.

The portable moveable horizontal to vertical pipe hander can be adapted to longitudinally support a vertical pipe handler in a nested position without deforming when in a retracted position.

The portable moveable horizontal to vertical pipe hander can include a tapered beam. The tapered beam can have a tapered side and a non-tapered side.

A bottom securing gripper can be connected with the non-tapered side. The bottom securing gripper can be attached to the non-tapered side at an angle from about eighty degrees to about one hundred twenty degrees.

A top securing gripper can be operably connected with the tapered beam on the non-tapered beam side. The top securing gripper can be secured at an angle from about eighty degrees to about one hundred twenty degrees proximate to the non-tapered side.

The top securing gripper can be longitudinally aligned with the bottom securing gripper.

A hinged connection can be formed in a second end of the tapered beam. The hinged connection can allow the tapered beam to move from a position substantially parallel to the ground to a position substantially perpendicular to the ground while holding a tubular.

A controller can be connected to the hydraulic lifting cylinder, the bottom securing gripper, and the top securing gripper. The controller can extend and retract the bottom securing gripper and the top securing gripper, and the controller can raise and lower the hydraulic lifting cylinder.

A plurality of axles can be attached to the high load non-deforming frame. The plurality of axles can support a plurality of wheels.

A braking system can be operatively attached to the plurality of axles.

A substructure connector can be used to connect the high load non-deforming frame to the substructure.

A set of walkers can be secured to the high load non-deforming frame for stabilizing the high load non-deforming frame when the hydraulic lifting cylinder is actuated.

An adjustable bottom support shoe can be slidably disposed on the non-tapered side of the tapered beam. The height adjustable bottom support shoe can enable the portable moveable horizontal to vertical pipe handler to have versatility sufficient to handle tubulars of many lengths.

The portable moveable horizontal to vertical pipe hander can be used with any rig for drilling wells.

Turning now to the Figures, FIG. 1 depicts a drilling rig in a deployed position over a wellbore 10.

Figure 2:
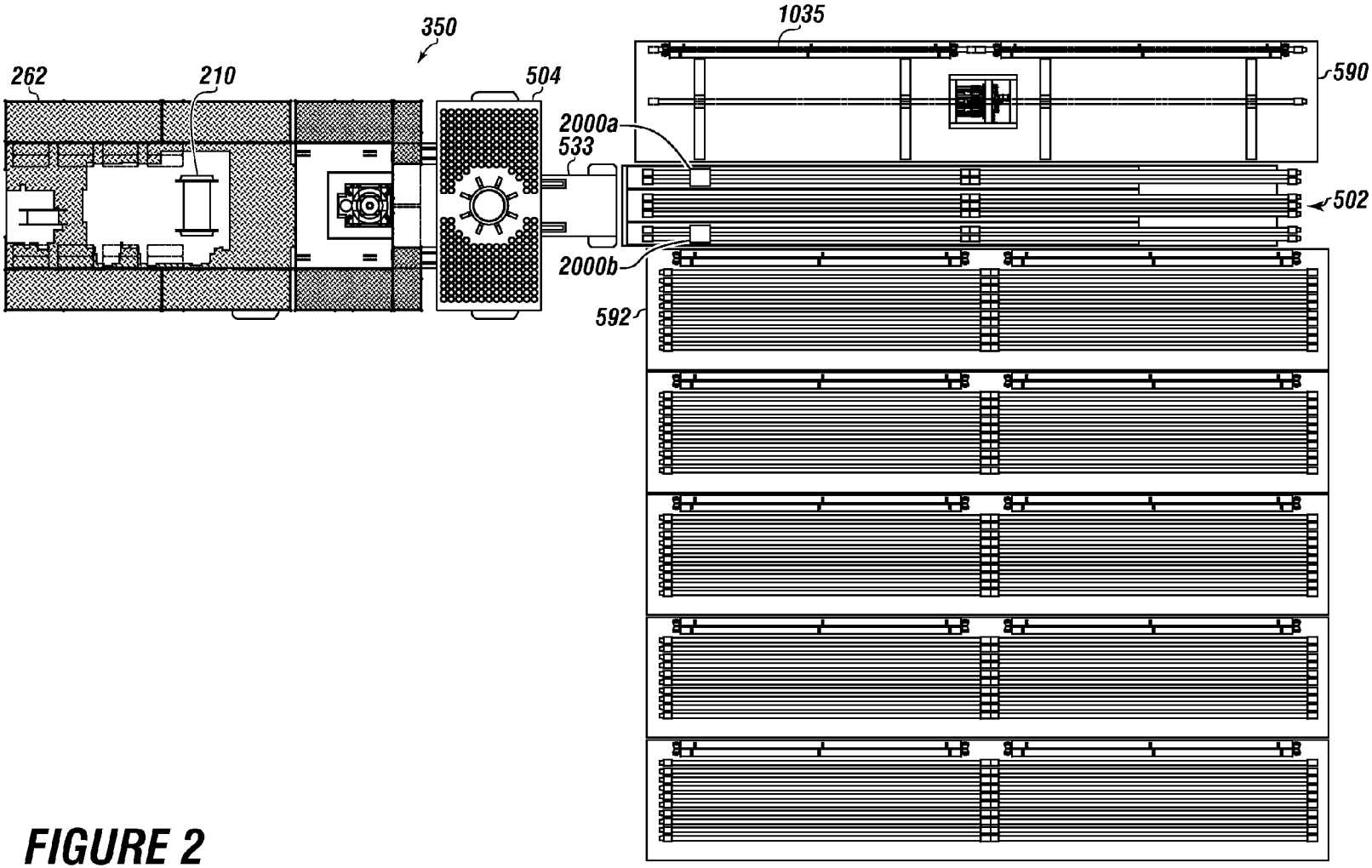
FIG. 2 depicts a top view of the horizontal to vertical pipe handler attached to a vertical pipe handler attached to the drilling rig of FIG. 1.

FIG. 2 depicts a top view of a horizontal to vertical pipe handler attached to a vertical pipe handler attached to the drilling rig of FIG. 1.

Referring to FIGS. 1 and 2, the drilling rig 350 can include a mast 203. The mast 203 can be connected to a subbase 263.

The drilling rig 350 can be coupled to a vertical pipe handler 504 using a coupler 533. The vertical pipe handler 504 is shown receiving a tubular 1035 from a portable moveable horizontal to vertical pipe handler 502.

Ghost lines in FIG. 1 show the vertical pipe handler 504 using pivot arms to present the tubular 1035 to the drilling rig for connection to the top drive 220 which can be attached to a drill line 216.

The drilling rig 350 can be mounted to a subbase trailer 262, which can be a trailer to which the subbase 263 is integrally attached.

The subbase trailer can have a high load non-deforming frame 250 onto which a winch 256 is mounted. The winch can be used to raise the mast 203.

The drill line 216 can run through a crown block 212 at the top of the mast 203. The drill line 216 can connect to the top drive 220 on one end and a drawworks 210 on an opposite end.

A guide dolly 218 can support the top drive 220 enabling the top drive to slide up and down the mast 203. The guide dolly 218 can be configured to traverse on the mast 203.

The portable moveable horizontal to vertical pipe hander 502 can be removably coupled to a vertical pipe handler 504. The vertical pipe handler 504 can be removably coupled to the subbase trailer 262.

The portable moveable horizontal to vertical pipe handler 502 can be fed tubulars, such as tubular 1035, one at a time in sequence from a bucking machine 590, a pipe tub 592, or combinations thereof.

The portable moveable horizontal to vertical pipe hander 502 can connect to the vertical pipe handler 504 using a coupler 533.

Also shown are the "tubular is on the horizontal to vertical pipe handler" sensors 2000*a* and 2000*b* and tapered beam location sensors 2010*a* and 2010*b*.

Figure 3:
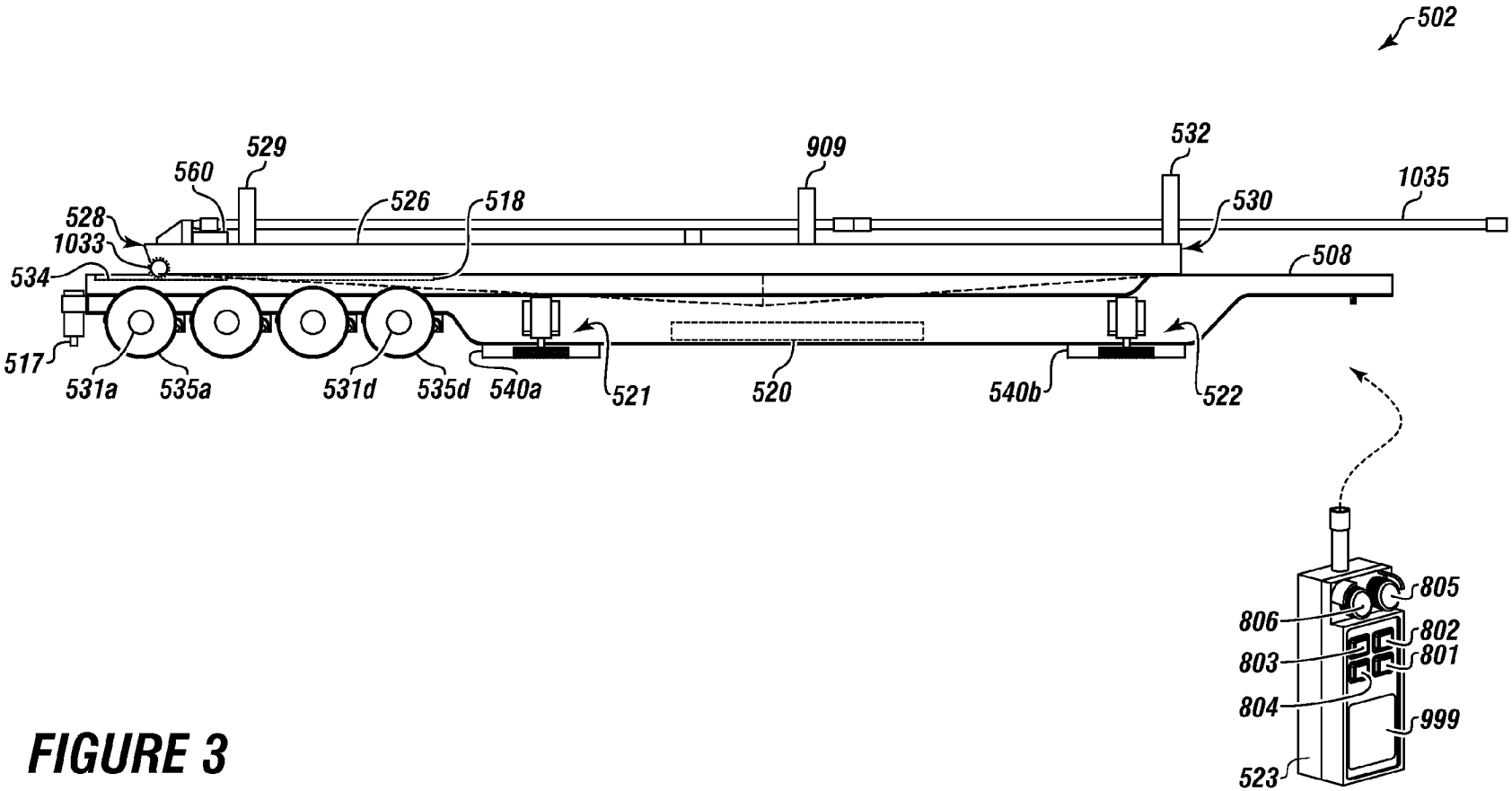
FIG. 3 depicts a side view of an embodiment of a portable moveable horizontal to vertical pipe handler with a controller for operating the portable moveable horizontal to vertical pipe handler.

FIG. 3 depicts an embodiment of the portable moveable horizontal to vertical pipe handler 502 with a tubular 1035.

The portable moveable horizontal to vertical pipe hander 502 can have a high load non-deforming frame 508. The high load non-deforming frame 508 can be made of metal, composites, or the like.

The high load non-deforming frame 508 is designed to support at least 10 tons without deforming.

One end of the high load non-deforming frame 508 can have a plurality of axles 531*a*-531*d* connected in parallel to each other.

Each of the axles can have a pair of wheels 535*a*-535*d*.

A pair of hydraulic lifting cylinders can be secured to the high load non-deforming frame 508. One of the hydraulic lifting cylinders 518 can be seen. When each hydraulic lifting cylinder is extended the tapered beam is raised away from the high load non-deforming frame.

A plurality of hydraulic lifting cylinders can be secured between the high load non-deforming frame and a hydraulic power unit.

A portion of a hydraulic lifting cylinder 518 of the plurality of hydraulic lifting cylinders can be secured to a vertical pipe handler for raising and lowering the vertical pipe handler between a horizontal position and a vertical position allowing the vertical pipe handler to be supported on transport supports of the portable moveable horizontal to vertical pipe handler for transport of both devices simultaneously.

A hydraulic power supply 520 can be in fluid communication with the plurality of hydraulic lifting cylinders and connected to a fluid reservoir (not shown) and a controller 523.

The portable moveable horizontal to vertical pipe hander 502 can include a tapered beam 526 disposed on the high load non-deforming frame 508.

The tapered beam 526 can have a tapered side 530 and a non-tapered side 528. The tapered beam 526 can be hinged or pinned to the high load non-deforming frame 508 with a pinion 1033 adjacent to the tapered side 530, thereby allowing the tapered beam 526 to move from a position substantially parallel to the ground to a position substantially perpendicular to the ground.

The pinion 1033 is formed in the non-tapered side allowing the tapered beam with grippers holding a tubular to pivot from a horizontal position on the high load non-deforming frame to a vertical position using the plurality of hydraulic lifting cylinders.

A plurality of bottom securing grippers 529 can be attached at an angle between eighty degrees and one hundred twenty degrees to the tapered beam 526 on the non-tapered side for opening and closing around a tubular 1035.

The plurality of bottom securing grippers 529 can be attached to the non-tapered side 528 of the tapered beam 526 for gripping, then lifting and positioning tubulars.

A plurality of top securing grippers 532 can be operably secured at an angle between eighty degrees and one hundred twenty degrees proximate to the tapered beam on the tapered side, for opening and closing around the tubular 1035, wherein the top securing gripper is longitudinally aligned with the bottom securing gripper.

The plurality of top securing grippers 532 can be operably attached on the tapered side 530 of the tapered beam 526.

A plurality of middle securing grippers 909 can be attached between the top securing grippers and the bottom securing grippers at an angle between eighty degrees and one hundred twenty degrees to the tapered beam on the non-tapered side for opening and closing around the tubular 1035.

In embodiments, two grippers can hold the tubular allowing a secure grip on different ends of the tubular so that tubular can be raised from the horizontal to a vertical position.

A controller 523 can be in communication with the portable moveable horizontal to vertical pipe hander 502. The controller 523 can operate the plurality of hydraulic lifting cylinders, the plurality of bottom securing grippers, the plurality of middle securing grippers, and the plurality of top securing grippers.

The controller 523 can be in communication with one or more sensors to present details of the horizontal to vertical pipe handler operation to an operator or a user of the remote controller, or to a third party monitoring the operations from a remote location, the sensors including: the "tubular is on the horizontal to vertical pipe handler" sensors; the pairs of moveable flipper sensors; the plurality of transfer arm location sensors; the plurality of transfer arm inclination sensors; the plurality of skate location sensors; and the plurality of tapered beam location sensors.

The controller can be battery operated. The controller can be wireless connected to the drilling rig, or have a wired connection to the drilling rig.

The controller can have an on button 801, an off button 802, a raise jacks button 803, a lower jacks button 804, a raise tapered beam from horizontal to a vertical position button 805, and a lower the tapered beam from a vertical to a horizontal position button 806.

The controller can include a processor with data storage that holds computer instructions that instruct a processor to transmit the signal to the hydraulic power supply, the jacks, or combinations thereof.

The controller can have a display 999 for showing an executive dashboard of status of the horizontal to vertical pipe handler operations using additional computer instructions in the controller that allow viewing of the angle of inclination, that provide a count of the number of tubulars handled, that provides information on the length of tubulars handled. The controller can engage additional sensors on the drilling rig which provide this information.

The controller can be a remote control unit that communicates to an onboard receiver which can instruct a hydraulic cylinder to extend or retract, and a bottom securing gripper, middle securing gripper and a top securing gripper to open and close around the tubular. The controller can connect with a plurality of onboard sensors and use computer instructions in the controller to present an executive dashboard to a user displaying the status and history of operation of the horizontal to vertical pipe handler in real time.

The controller can be in a wired communication from a distance with the handler, or in wireless communication with the handler using the Internet, a cellular network, a satellite network, or combinations thereof.

The high load non-deforming frame 508 can include a set of walkers 521 and 522 secured to the high load non-deforming frame 508 for stabilizing the high load non-deforming frame 508 when the hydraulic lifting cylinder 518 is actuated. Bearing pads 540*a* and 540*b* can be adjacent the set of walkers 521 and 522.

The set of walkers 521 and 522 can include shoes.

The high load non-deforming frame 508 can include an adjustable bottom support shoe 560 configured to control the position of the tubulars when held by the portable moveable horizontal to vertical pipe hander 502.

The portable moveable horizontal to vertical pipe handler further includes a trailer mating pin 517 connected to the high load non-deforming frame for coupling the frame to a rig or vertical pipe handler.

Figure 4A:
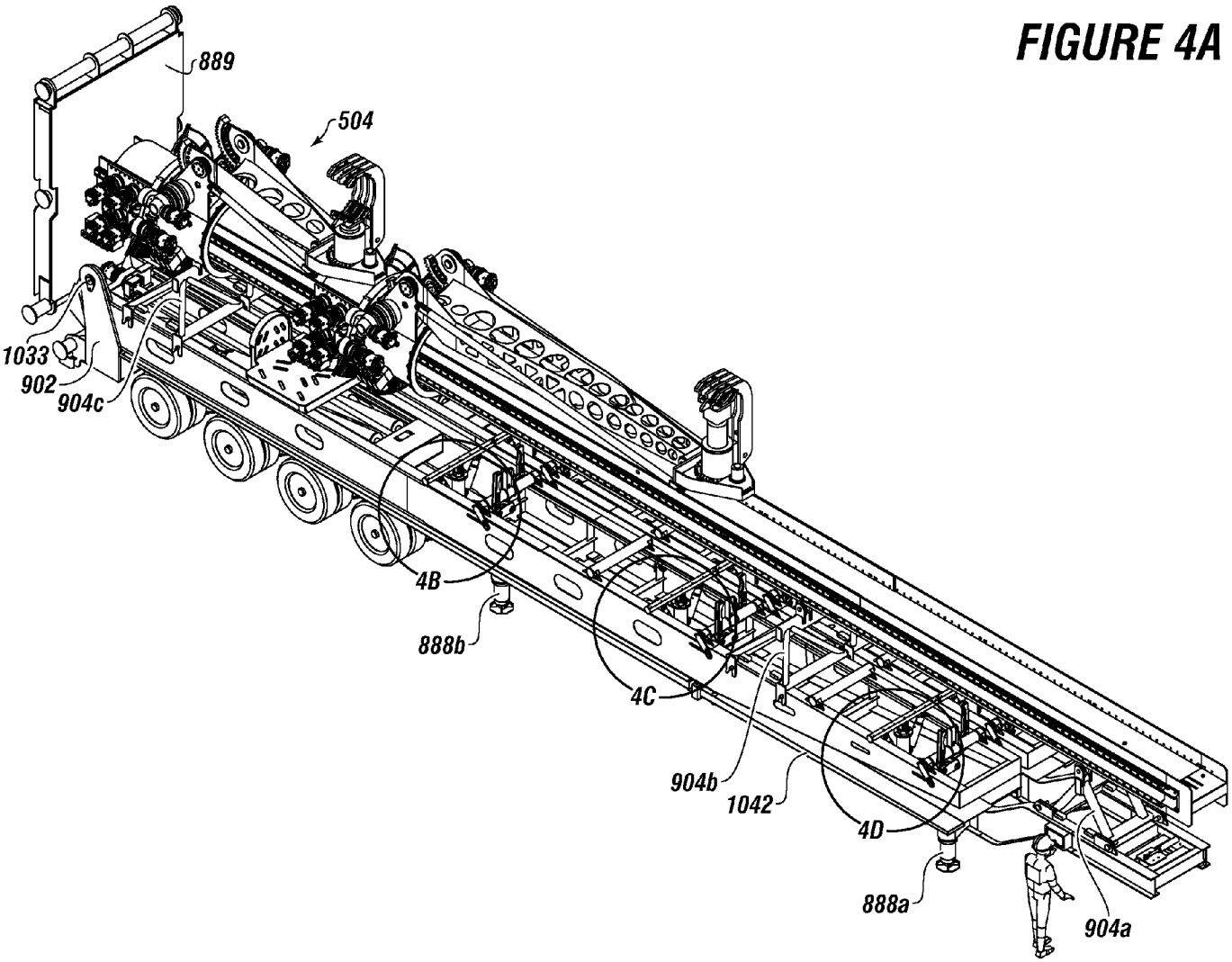
FIG. 4A depicts a top perspective view of the horizontal to vertical pipe handler supporting a vertical pipe handler for transport.

FIG. 4A shows an embodiment of the portable moveable horizontal to vertical pipe handler.

Figure 4D:
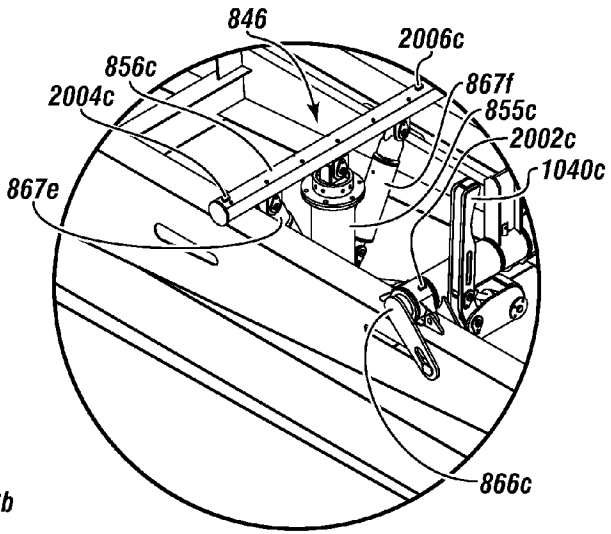
FIGS. 4B, 4C, and 4D depict details from the horizontal to vertical pipe handler shown in FIG. 4A.
Figure 4C:
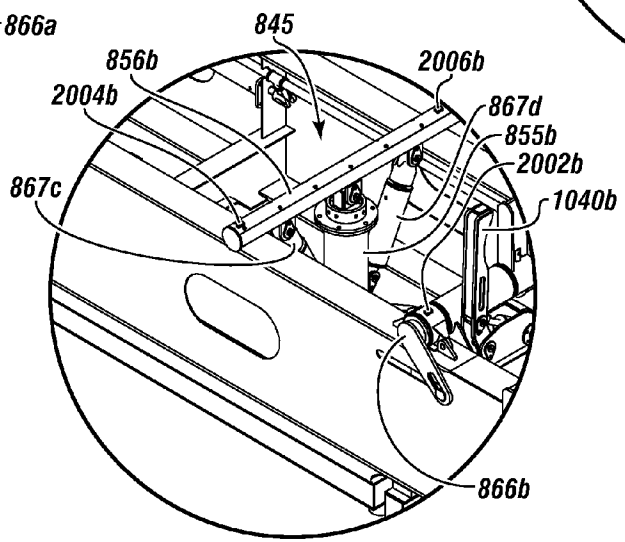
Figure 4B:
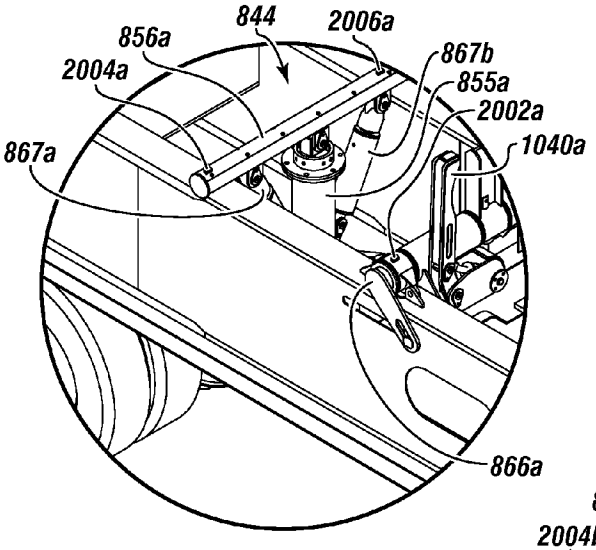

FIGS. 4B-4D show detailed views of the transfer arm and rotating cylinder assemblies of the portable moveable horizontal to vertical pipe handler.

Referring to FIGS. 4A-4D, the portable moveable horizontal to vertical pipe handler can have a plurality of transport supports, including rear transport support 904*c*, middle transport support 904*b*, and front transport support 904*a*.

The portable moveable horizontal to vertical pipe handler can include a plurality of uniquely designed transfer arm and rotating cylinder assemblies 844, 845, 846. From three to nine such assemblies can be used on the frame. Three of six transfer arm and rotating cylinder assemblies are viewable in these Figures.

Each transfer arm and rotating cylinder assembly can have a rotating cylinder 855*a*, 855*b*, 855*c* attached to a transfer arm 856*a*, 856*b*, 856*c*. The cylinder can rotate, allowing the transfer arm to move from parallel to the tapered beam or aligned with a longitudinal axis of the tapered beam to a position ninety degrees from the longitudinal axis, allowing a tubular to slide from a pipe tub or bucking machine onto the portable moveable horizontal to vertical pipe handler.

Also shown are a plurality of tubular retention assemblies 1040*a*, 1040*b*, 1040*c* secured to the high load non-deforming frame of the portable moveable horizontal to vertical pipe handler. Up to six of the tubular retention assemblies can be used on a frame. Three of six tubular retention assemblies are shown.

The portable moveable horizontal to vertical pipe handler can have a plurality of tilt cylinders 867*a*, 867*b*, 867*c*, 867*d*, 867*e*, 867*f*.

Each tilt cylinder can attach to a transfer arm for rolling a tubular from the portable moveable horizontal to vertical pipe handler to a bucking machine 590 or a pipe rack 592 shown in FIG. 2.

Each tilt cylinder can connect to the hydraulic power supply.

The plurality of transfer arm and rotating cylinder assemblies can be secured to the high load non-deforming frame.

Each transfer arm 856*a*, 856*b*, 856*c* can be positioned by one of the rotating cylinders 855*a*, 855*b*, 855*c* at an angle from forty-five degrees to ninety degrees from the tapered beam allowing tubulars to roll from a bucking machine or pipe tub into the plurality of securing grippers.

The transfer arms can include a plurality of transfer arm location sensors 2004*a*, 2004*b*, 2004*c*, wherein each transfer arm location sensor can transmit signals on the location of the transfer arm relative to the tapered beam.

The transfer arms can include a plurality of transfer arm inclination sensors 2006*a*, 2006*b*, 2006*c* for transmitting signals on the angle of inclination of the transfer arm relative to the tapered beam.

The portable moveable horizontal to vertical pipe handler can use from three to nine transfer arm and rotating cylinder assemblies connected to and spaced equidistantly along the high load non-deforming frame.

Jacks 888*a* and 888*b* can be used to stabilize the frame while in operation.

Up to four jacks can be used on the portable moveable horizontal to vertical pipe handler.

A fluid retention tray 1042 can be disposed under the high load non-deforming frame for containment of hydraulic fluid or other fluid spills during operation of the portable moveable horizontal to vertical pipe handler.

A plurality of pairs of moveable flippers, wherein each pair of moveable flippers can be moved from a position longitudinal to one of the transfer arms to a position perpendicular to the transfer arm to stop rolling of a tubular positioned on the transfer arm and the moveable flippers can be connected to the hydraulic power supply.

Three of six pairs of moveable flippers 866*a*, 866*b*, 866*c* are shown.

The pairs of moveable flippers can include pairs of moveable flipper sensors 2002*a*, 2002*b*, 2002*c* for transmitting signals to the controller on the location of each moveable flipper.

In FIG. 4A, the high load non-deforming frame is shown with a vertical pipe handler 504 disposed over the portable moveable horizontal to vertical pipe handler enabling the two units to be transported on the frame of the portable moveable horizontal to vertical pipe handler, saving space, reducing the number of drivers needed, and reducing fuel consumption by the drilling rig operation.

A base 889 can be rotatably attached to the high load non-deforming frame to ensure accurate alignment of the vertical pipe handler over the portable moveable horizontal to vertical pipe handler.

A hinge pin 902 can be mounted between the high load non-deforming frame and a vertical pipe handler 504.

The pinion 1033 is shown in FIG. 4A.

Figure 5:
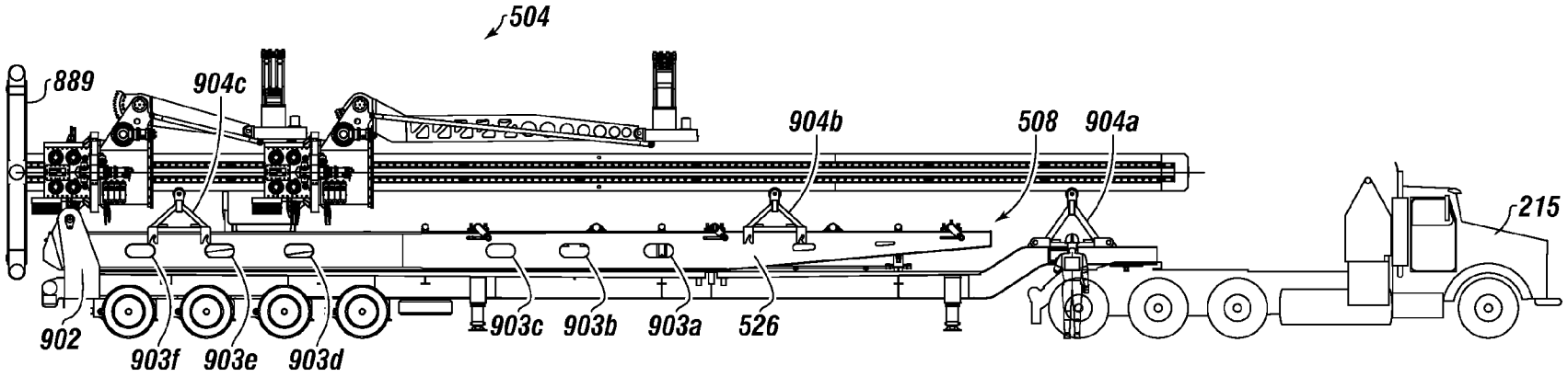
FIG. 5 is a side view of an embodiment of a horizontal to vertical pipe handler supporting a vertical pipe handler for transport using a prime mover.

FIG. 5 shows a side view of the portable moveable horizontal to vertical pipe handler connected to a vertical pipe handler 504 in the transport position.

A plurality of transport supports 904*a*, 904*b*, 904*c* can be used to support the vertical pipe handler on the high load non-deforming frame 508.

A plurality of perforations 903*a*, 903*b*, 903*c*, 903*d*, 903*e*, 903*f* can be formed in the high load non-deforming frame to reduce weight and wind resistance during transport.

The portable moveable horizontal to vertical pipe handler can be connected to a prime mover 215, such as a truck.

Also shown are the tapered beam 526, base 889, and hinge pin 902.

Figure 6:
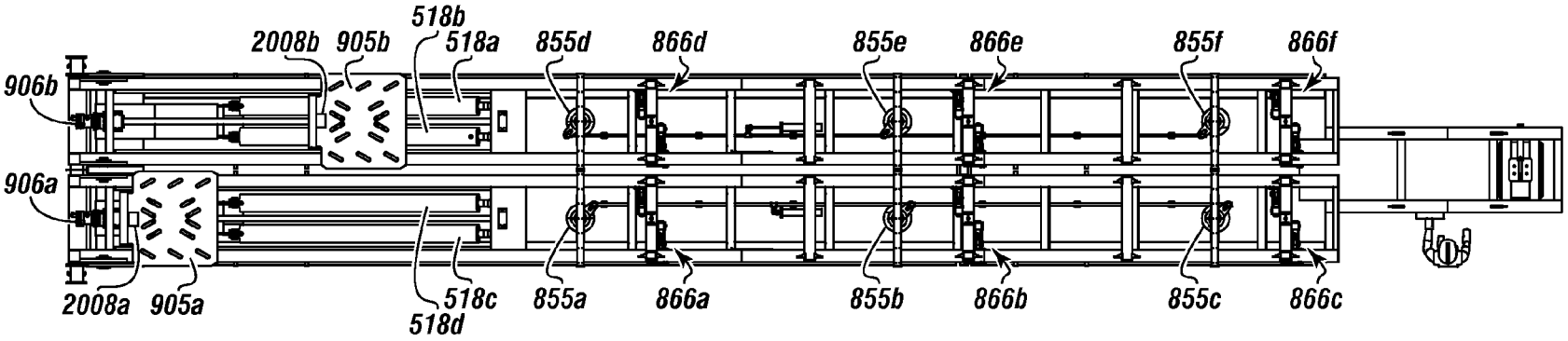
FIG. 6 is a top view of a portion of the horizontal to vertical pipe handler.

FIG. 6 shows a top view of the portable moveable horizontal to vertical pipe handler.

A first moveable skate 905*a* can be connected to and moveable along the tapered beam from an end to a middle portion of the beam.

A second moveable skate 905*b* can be connected to and moveable along the tapered beam independent of the first moveable skate 905*a*.

The moveable skates can be moved independently and elevate the tubular while the tubular is near the plurality of securing grippers, wherein the moveable skates can be moved using the hydraulic power unit.

The moveable skates 905*a*, 905*b* can be moved by power screws 906*a*, 906*b* respectively. The power screws can be powered by the hydraulic power unit.

Each movable skate can include a skate location sensor 2008*a*, 2008*b* for transmitting signals on the position of the skate relative to an end of the tapered beam.

A plurality of the hydraulic lifting cylinders 518*a* 518*b*, 518*c*, 518*d* can be secured between the high load non-deforming frame and the hydraulic power unit.

The portable moveable horizontal to vertical pipe handler can include a plurality of transfer arm and rotating cylinder assemblies as shown in FIGS. 4B-4D. Each transfer arm and rotating cylinder assembly can have a rotating cylinder 855*a*, 855*b*, 855*c*, 855*d*, 855*e*, 855*f* attached to one of the transfer arms 856*a*, 855*b*, 855*c*, 855*d*, 855*e*, 855*f*. The rotating cylinders can each rotate a transfer arm from a position parallel to the tapered beam or aligned with a longitudinal axis of the tapered beam to a position ninety degrees from the longitudinal axis of the tapered beam allowing a tubular to slide from a pipe tub or bucking machine onto the horizontal to vertical pipe handler.

While these embodiments have been described with emphasis on the embodiments, it should be understood that within the scope of the appended claims, the embodiments might be practiced other than as specifically described herein.

What is claimed is:

1. A portable moveable horizontal to vertical pipe handler for use in orienting a tubular from a horizontal position to a vertical position for use with a drilling rig, wherein the portable moveable horizontal to vertical pipe hander comprises:

a. a frame;

b. a beam having a first side and a second side;

c. a hydraulic lifting cylinder secured between the frame and the beam;

d. a bottom securing gripper attached to the beam on second side for opening and closing around the tubular while in the bottom securing gripper;

e. a top securing gripper attached to the beam on the first side for opening and closing around the tubular, wherein the top securing gripper is longitudinally aligned with the bottom securing gripper;

f. a pinion formed in the second side allowing the beam to pivot from a horizontal position on the frame to a vertical position using the hydraulic lifting cylinder;

g. a moveable skate connected to and moveable along the beam, wherein the moveable skate is moveable to elevate the tubular;

h. a plurality of transfer arms and rotating cylinder assemblies secured to the frame, the plurality of transfer arms and rotating cylinder assemblies being configured to allow the tubular to roll into the top securing gripper or the bottom securing gripper;

i. a plurality of pairs of moveable flippers coupled to the frame to stop rolling of the tubular positioned on the plurality of transfer arms, and j. a controller in communication with at least one of the hydraulic lifting cylinder, the top securing gripper, the bottom securing gripper, or the moveable skate, wherein the controller comprises a processor with a data storage containing computer instructions for operating at least one of the hydraulic lifting cylinder, the top securing gripper, the bottom securing gripper, or the moveable skate, synchronously or independently, to raise and lower the tubular.

2. The portable moveable horizontal to vertical pipe handler of claim 1, wherein the moveable skate is moved by a power screw, and wherein the power screw is powered by a hydraulic power unit.

3. The portable moveable horizontal to vertical pipe handler of claim 1, further comprising a set of walkers secured to the frame for stabilizing the frame when the hydraulic lifting cylinder is actuated.

4. The portable moveable horizontal to vertical pipe handler of claim 1, further comprising a plurality of bearing pads connected to the frame.

5. The portable moveable horizontal to vertical pipe handler of claim 1, further comprising a trailer mating pin connected to the frame for coupling the frame to the drilling rig or to a vertical pipe handler.

6. The portable moveable horizontal to vertical pipe handler of claim 1, wherein the portable moveable horizontal to vertical pipe handler receives the tubular from a bucking machine, a pipe tub, or combinations thereof, and transfers the tubular to the drilling rig for connection to a top drive, which then turns and lowers the tubular into a wellbore.

7. The portable moveable horizontal to vertical pipe handler of claim 1, further comprising a plurality of transport supports for supporting a vertical pipe handler on the portable moveable horizontal to vertical pipe handler for transporting the portable moveable horizontal to vertical pipe handler and the vertical pipe handler simultaneously.

8. The portable moveable horizontal to vertical pipe handler of claim 7, wherein a portion of the hydraulic lifting cylinder raise and lower the vertical pipe handler between a horizontal position and a vertical position.

9. The portable moveable horizontal to vertical pipe handler of claim 1, wherein each transfer arm of the transfer arm and rotating cylinder assemblies can be positioned by one of the rotating cylinders of the transfer arm and rotating cylinder assemblies at an angle from forty-five degrees to ninety degrees from the beam.

10. The portable moveable horizontal to vertical pipe handler of claim 9, further comprising from three to nine transfer arm and rotating cylinder assemblies connected to and spaced equidistantly along the frame.

11. The portable moveable horizontal to vertical pipe handler of claim 9, comprise a plurality of tilt cylinders, wherein a portion of the tilt cylinder attaches to a transfer arm for rolling the tubular from the portable moveable horizontal to vertical pipe handler to the bucking machine or the pipe tub, and wherein the plurality of tilt cylinders are connected to a hydraulic power supply.

12. The portable moveable horizontal to vertical pipe handler of claim 9, wherein each pair of the plurality of pairs of moveable flippers is moved from a position longitudinal to one of the transfer arms to a position perpendicular to one of the transfer arms and the plurality of pairs of moveable flippers are connected to a hydraulic power supply.

13. The portable moveable horizontal to vertical pipe handler of claim 1, further comprising a plurality of tubular retention assemblies secured to the frame of the horizontal to vertical pipe handler for holding the tubular onto the horizontal to vertical pipe handler.

14. The portable moveable horizontal to vertical pipe handler of claim 1, further comprising a fluid retention tray disposed beneath the frame for containment of a hydraulic fluid or other fluid spills during operation of the portable moveable horizontal to vertical pipe handler.

15. The portable moveable horizontal to vertical pipe handler of claim 1, further comprising a plurality of jacks for stabilizing and leveling the frame for safe operation.

16. The portable moveable horizontal to vertical pipe handler of claim 15, wherein the controller communicates to a hydraulic power supply, the jacks, wirelessly or in a wired manner, for remotely controlling the portable moveable horizontal to vertical pipe handler.

17. The portable moveable horizontal to vertical pipe handler of claim 15, wherein the controller comprises an on button, an off button, a raise jacks button, a lower jacks button, raise beam from horizontal to a vertical position button, a lower beam from a vertical to a horizontal position button, and computer instructions in the controller that instruct a processor to transmit a signal to a hydraulic power supply or the jacks.

18. The portable moveable horizontal to vertical pipe handler of claim 1, further comprising a hinge pin between the frame and the beam.

19. The portable moveable horizontal to vertical pipe handler of claim 1, further comprising a plurality of perforations formed in the frame.

20. The portable moveable horizontal to vertical pipe handler of claim 1, further comprising on one end of the frame a plurality of axles connected in parallel to each other and at least one pair of wheels connected to each axle, wherein the frame connects to a prime mover for transporting the portable moveable horizontal to vertical pipe handler on a roadway.

21. The portable moveable horizontal to vertical pipe handler of claim 1, further comprising at least one of:

a. a tubular is on the horizontal to vertical pipe handler sensor for transmitting signals to the controller;

b. a pair of moveable flipper sensors for transmitting signals to the controller on the location of a pair moveable flippers;

c. a plurality of transfer arm location sensors, wherein each transfer arm location sensor transmits signals on the location of a transfer arm relative to the beam;

d. a plurality of transfer arm inclination sensors for transmitting signals on the angle of inclination of the transfer arm relative to the beam;

e. a plurality of skate location sensors for transmitting signals on the position of the first moveable skate, the second moveable skate, or combinations thereof relative to an end of the beam; or f. a plurality of beam location sensors for transmitting signals on the position of the beam between a horizontal position and a vertical position.

* * * * *